US011261709B2

(12) United States Patent
Green et al.

(10) Patent No.: US 11,261,709 B2
(45) Date of Patent: Mar. 1, 2022

(54) DOWNHOLE GRAVEL PACKING APPARATUS AND METHOD

(71) Applicant: Swellfix UK Limited, Aberdeenshire (GB)

(72) Inventors: Annabel Green, Huntly (GB); Oliver Webster, Torphins (GB)

(73) Assignee: Swellfix UK Limited, Aberdeenshire (GB)

( * ) Notice: Subject to any disclaimer, the term of this patent is extended or adjusted under 35 U.S.C. 154(b) by 36 days.

(21) Appl. No.: 16/618,642

(22) PCT Filed: Jun. 13, 2018

(86) PCT No.: PCT/GB2018/051616
§ 371 (c)(1),
(2) Date: Dec. 2, 2019

(87) PCT Pub. No.: WO2018/229484
PCT Pub. Date: Dec. 20, 2018

(65) Prior Publication Data

US 2021/0148197 A1 May 20, 2021

(30) Foreign Application Priority Data

Jun. 14, 2017 (GB) ..... 1709421

(51) Int. Cl.
*E21B 43/04* (2006.01)
*E21B 34/06* (2006.01)
(Continued)

(52) U.S. Cl.
CPC ..... *E21B 43/04* (2013.01); *E21B 34/063* (2013.01); *E21B 34/10* (2013.01); *E21B 43/08* (2013.01); *E21B 43/12* (2013.01)

(58) Field of Classification Search
CPC ..... E21B 43/04; E21B 34/10; E21B 43/08; E21B 34/063; E21B 43/12
See application file for complete search history.

(56) References Cited

U.S. PATENT DOCUMENTS

2006/0042798 A1 3/2006 Badalamenti et al.
2006/0175065 A1 8/2006 Ross
(Continued)

FOREIGN PATENT DOCUMENTS

WO WO-2016/059501 A1 4/2016

OTHER PUBLICATIONS

International Search Report PCT/ISA/210 for International Application No. PCT/GB2018/051616 dated Sep. 3, 2018.
(Continued)

*Primary Examiner* — Michael R Wills, III
(74) *Attorney, Agent, or Firm* — Harness, Dickey & Pierce, P.L.C.

(57) ABSTRACT

A downhole gravel packing apparatus, comprising: a tubular assembly for being arranged within a wellbore to define an annulus between said tubular assembly and a wall of the wellbore; and a control valve provided within the tubular assembly to control flow of a gravel pack carrier fluid between external and internal regions of the tubular assembly, the control valve comprising a fluid reactant arrangement which reacts with a first fluid to reconfigure the control valve from a first configuration in which flow through the control valve is permitted during a gravel packing operation, and a second configuration in which flow through the control valve is restricted.

24 Claims, 6 Drawing Sheets

(51) Int. Cl.

| | |
|---|---|
| ***E21B 34/10*** | (2006.01) |
| ***E21B 34/08*** | (2006.01) |
| ***E21B 34/12*** | (2006.01) |
| ***E21B 43/08*** | (2006.01) |
| ***E21B 43/12*** | (2006.01) |

(56) References Cited

U.S. PATENT DOCUMENTS

| | | | | |
|---|---|---|---|---|
| 2011/0303420 | A1* | 12/2011 | Thorkildsen | E21B 43/04 166/373 |
| 2015/0021019 | A1* | 1/2015 | Veit | E21B 43/12 166/250.15 |
| 2015/0198016 | A1* | 7/2015 | Langlais | E21B 43/04 166/51 |
| 2015/0308226 | A1 | 10/2015 | Killie et al. | |
| 2015/0308238 | A1 | 10/2015 | Langlais | |
| 2016/0076337 | A1 | 3/2016 | Harper et al. | |
| 2017/0306738 | A1* | 10/2017 | Voll | F16K 15/023 |
| 2018/0328139 | A1* | 11/2018 | Mhaskar | E21B 34/085 |
| 2020/0003034 | A1* | 1/2020 | Ismail | E21B 43/12 |

OTHER PUBLICATIONS

Written Opinion of International Search Report PCT/ISA/237 for International Application No. PCT/GB2018/051616 dated Sep. 3, 2018.

Great Britain Office Action for Application No. GB1709421.0 dated Nov. 23, 2017.

International Preliminary Report on Patentability for corresponding Application No. PCT/GB2018/051616 dated Dec. 26, 2019.

* cited by examiner

DOWNHOLE GRAVEL PACKING APPARATUS AND METHOD

FIELD

The present disclosure relates to downhole gravel packing apparatuses and methods.

BACKGROUND

In the oil and gas industry wellbores are drilled to intercept subterranean hydrocarbon bearing formations or reservoirs, with appropriate completion infrastructure installed within the wellbores to support production, or injection as may be required. The geology of a particular reservoir is carefully considered and can determine the type of completion infrastructure which may be required. For example, some reservoirs may comprise weak sandstone regions which require sand control solutions, to minimise the production of sand with the hydrocarbons.

Many sand control solutions exist and the selection of the most appropriate solution is dependent on a number of factors, a key one being the properties of the sand particles, particularly their size and range of size within a particular sand body, as defined by its sorting or uniformity coefficient. It is accepted as best practice in sands with high fines content and/or poor sorting (large range of sand particle sizes) to control the sand using gravel packing techniques Gravel packing involves pumping a slurry of a carrier fluid (such as water) and gravel (which normally comprises a specifically chosen size of sand or other aggregate or particulate material) into an annulus between the wellbore and a sand screen completion. The carrier fluid exits the annulus via the screens and returns to surface, with the gravel remaining packed in place within the annulus.

In some circumstances, such as in deviated or horizontal wells, gravel packing may be performed using a technique referred to as alpha beta packing. In alpha beta packing the gravel pack slurry is initially pumped into the annulus at a velocity which allows gravel to drop out and form a sand dune which builds up from the heel of the well and travels towards the toe. This is referred to as the alpha wave. Once the toe of the annulus is reached the gravel continues to pack the annular area in a returning dune that fills the annulus from toe to heel, referred to as the beta wave.

As the beta wave fills the annulus, the length of exposed screen for fluid to return to the tubing reduces, thus the length of the return path increases causing pressure to increase.

The above pressure increase may be exacerbated by the use of inflow control devices (ICDs) which are frequently used in horizontal wells to manage production. The ICDs are deployed on each inflow path between the annulus and the tubing and apply a pressure drop, thus increasing the pressure in the annulus.

The combination of the above factors means that pumping fluids used to form the gravel pack are at risk of exceeding the fracture strength of the formation and thus damaging the formation.

Further, in some instances of alpha beta packing, it might be preferred to fill as much of the annulus during the alpha phase, which requires controlling the velocity of the gravel slurry to allow a larger proportion of the gravel to drop out. However, it is often desirable for the wellbore to be compartmentalised using zonal isolation packers, such as swellable packers. The preferred method to prevent gravel from accumulating around the packers, which would otherwise compromise effective zonal isolation, is to maintain annulus velocities past the larger outer diameters defined by the packers sufficiently to prevent gravel from dropping out of the slurry in these areas. There is therefore a conflict between reducing velocities in order to maximise the alpha dune height, and maintaining velocities to ensure successful zonal isolation.

Another method of gravel packing involves the use of a viscous carrier fluid which holds the gravel in suspension before flowing through the sand screen and to the surface. This viscous carrier fluid and gravel mix is pumped into the annulus and slowly fills the annulus from toe to heel. Analogously to alpha beta packing, this method of gravel packing would benefit from a high in-flow rate being provided during the gravel packing phase, to allow the viscous fluid to return to the surface. Presently, the use of ICDs to restrict in-flow prevents the viscous carrier fluid from efficiently leaving the annulus and returning to the surface.

SUMMARY

An aspect of the present disclosure relates to a downhole gravel packing apparatus, comprising:

- a tubular assembly for being arranged within a wellbore to define an annulus between said tubular assembly and a wall of the wellbore; and
- a control valve provided within the tubular assembly to control flow of a gravel pack carrier fluid between external and internal regions of the tubular assembly, the control valve comprising a fluid reactant arrangement which reacts with a first fluid to reconfigure the control valve from a first configuration in which flow through the control valve is permitted during a gravel packing operation, and a second configuration in which flow through the control valve is restricted.

The downhole gravel packing apparatus may be used to set up a gravel pack as a sand control solution in wells with weak sandstone regions, in order to minimise the production of sand with the hydrocarbons.

In use, a gravel pack may be located within the annulus such that hydrocarbons can enter the tubular assembly through the gravel pack, but the inflow of sand is controlled. To install the gravel pack, a slurry of a carrier fluid (such as water) and gravel (which normally comprises a specifically chosen size of sand or other aggregate or particulate material) may be pumped into the annulus. The carrier fluid may exit the annulus via the control valve and return to the surface via production tubing. The gravel will remain in place within the annulus, forming the gravel pack.

The control valve may control the inflow of the gravel pack carrier fluid, into the tubular assembly. In the first configuration, the control valve allows flow through the control valve. In the first configuration, the gravel pack carrier fluid may flow through the control valve and enter the tubular assembly at a first flow rate. The first flow rate may be a high flow rate. A high flow rate may help to reduce, or manage, the pressure increase within the annulus during gravel packing, since maximum potential fluid return flow is maximised, thus minimising the pressure gradient from the interior to the exterior of the tubular housing.

In the second configuration, flow through the control valve is restricted. Accordingly, the rate at which fluid may flow through the control valve, into the tubular assembly, may be reduced. In the second configuration, the control valve may allow flow into the interior of the tubular assembly at a second flow rate. The second flow rate may be lower than the first flow rate.

The restricted inflow through the control valve in the second configuration may cause a pressure drop across the control valve and thus increase pressure within the annulus. The control valve in the second configuration may therefore be used to control production in a section of the wellbore.

The control valve may therefore, apply a first—lower—pressure drop when in the first configuration and a second—higher—pressure drop when in the second configuration. Accordingly, when the control valve is in the first configuration, the pressure drop across the tubular housing will be lower and the risk of formation fracturing is reduced. However, when the control valve is in the second configuration, the pressure drop across the tubular housing may be higher, thus controlling production as required.

When in a second configuration, the control valve may be, or act as, an inflow control device (ICD), in order to control the inflow of fluid into the tubular assembly and thus control pressure within the annulus and thus production in a section of the wellbore.

In this way, a downhole gravel packing apparatus may use a, or several, control valves in place of what would traditionally be ICDs. The control valves may provide increased performance during gravel packing (since the annulus pressure can be minimised while flow through the control valve is not restricted) and then provide analogous performance to ICDs during production (since the control valves can restrict flow—and act as ICDs—in the second configuration).

In the second configuration, the control valve may be closed. In a second configuration, flow through the control valve may be prevented. The second flow rate may be zero. The control valve may be a non-return valve (NRV) when in a second configuration.

If the control valve is closed and flow through the control valve is prevented when the control valve is in the second configuration, no fluid can flow from the exterior to the interior of the tubular assembly via the control valve. Accordingly, fluid must enter the tubular assembly via an alternative route.

The downhole gravel packing apparatus may comprise an inflow control device (ICD). The control valve may comprise the ICD, or the ICD may be separate to the control valve.

The ICD may be located parallel to the control valve and thus may provide an alternative route for fluid to enter the interior of the tubular assembly from the exterior.

If flow is prevented through the control valve when the control valve is in the second configuration, fluid may have to flow through the ICD to enter the tubular assembly. In such an arrangement, a first maximum flow rate from the exterior to the interior of the tubular assembly is determined by the flow through the control valve (in the first configuration) and the ICD, and a second maximum flow rate from the exterior to the interior of the tubular assembly is determined by the ICD alone (since fluid cannot flow through the control valve in the second configuration)—accordingly, the ICD may determine the annulus pressure during production.

The ICD may be used to control the pressure drop across the tubular assembly and thus may be used to control the pressure in the annulus and thus production, when the control valve is in a second configuration.

If flow through the control valve is prevented when the control valve is in the second configuration, the control valve may act as a closed section of tubing.

The tubular assembly may comprise an ICD housing. The ICD housing may house the ICD. The ICD housing may house the control valve. The control valve may be housed parallel (functionally) to the ICD.

The tubular assembly may comprise a sand screen. The tubular assembly may comprise a sand screen housing for supporting the sand screen. The ICD housing may support the sand screen. The tubular assembly may comprise a base pipe. The base pipe may form part of production tubing. The sand screen may be arranged concentrically around the base pipe. The sand screen may circumscribe the base pipe.

A screen annulus may be defined between the sand screen and the base pipe. The screen annulus may be arranged such that fluid may enter the screen annulus from the annulus via the sand screen. The sand screen may define the outer surface of the tubular assembly. The sand screen may define the outer surface of the downhole gravel packing apparatus.

The control valve may be located in the base pipe. The control valve may be configured to (at least when in a first configuration) permit flow from the screen annulus into the interior of the base pipe (and thus to the surface).

In other arrangements, the control valve or a plurality of control valves may be positioned radially outward from the base pipe, around the base pipe. The control valve or a plurality of control valves may be arranged longitudinally with respect to the base pipe such that flow through the control valve runs substantially parallel to flow in the base pipe.

The ICD may be located in the base pipe. The ICD may be configured to permit flow from the screen annulus into the interior of the base pipe and thus to the surface. The ICD may be located in parallel to the control valve.

The control valve is reconfigured from the first configuration to the second configuration by a fluid reactant arrangement. The fluid reactant arrangement reacts to a first fluid to reconfigure the control device. This reaction and reconfiguring may be substantially instantaneous or may happen over a period of time.

The control valve may comprise a flow control member and an orifice. Fluid may flow through and out the control valve via the orifice. The control valve may comprise an inlet for fluid entering the control valve. Fluid may flow from the inlet, through the control valve and out via the orifice.

When the control valve is in the first configuration, the flow control member may be in a first position and fluid may flow through the orifice (e.g. at a first rate). When the control valve is in the second configuration, the flow control member may be in a second position and may restrict flow through the orifice (e.g. a second flow rate). In the second position, the flow control member may obscure, cover, or impede the orifice. When in the second position, the flow control member may block the orifice and prevent fluid flow through the orifice.

The flow control member may be moved from the first position to the second position by the fluid reactant arrangement. Alternatively, the flow control member may be maintained in a first position by the fluid reactant arrangement. The fluid reactant arrangement may be arranged to hold the flow control member in the first position when the control valve is in the first configuration. When the control valve is in the second configuration, the fluid reactant arrangement may no longer maintain the flow control member in the first position. When the fluid reactant arrangement is no longer maintaining the flow control member in the first position, the flow control member may move to the second position under the action of fluid flow through the control valve or under the action of a biasing member.

The fluid reactant arrangement may comprise a material which dissolves in the first fluid. Accordingly, the fluid reactant arrangement may partially, or fully, dissolve in the first fluid.

It is to be understood that the term dissolves, as used herein is also used to cover disintegration, i.e. the use of "dissolves" is felt to cover fluid reactant arrangements which disintegrate in the first fluid. Further dissolving mechanisms (and thus phenomena covered by the term "dissolve") include corrosion and degradation.

The fluid reactant arrangement may comprise or consist of magnesium alloys. The fluid reactant arrangement may comprise or consist of aluminium, or impregnated plastic (e.g. polyglycolic acid).

The fluid reactant arrangement may comprise a dissolvable support. The dissolvable support may be arranged to hold the control valve in an open configuration when the control valve is in the first configuration. The dissolvable support may be arranged to dissolve in the first fluid and cause the control valve to be reconfigured to the second configuration. The control valve may be shut in the second arrangement. The dissolvable support, once exposed to the first fluid, may dissolve over a predictable period of time.

The dissolvable support may be arranged to hold the flow control member in the first position. When exposed to the first fluid, the dissolvable support may dissolve and the flow control member may be free to move to the second position.

The dissolvable support may be a component shaped so as not to block the passage of fluid through the control valve, but able to hold the flow control member in the first position. The dissolvable support may be a disc or sheet with holes in for fluid to pass through.

The control valve may comprise a chamber arranged such that fluid flowing through the control valve flows through the chamber and out of the orifice. Fluid may flow into the chamber (e.g. from the inlet) and then out of the chamber through the orifice. The flow control member may be located within the chamber.

The flow control member may be a ball trapped in the chamber. In the first position, the flow control member may not impede flow through the orifice. In the second position, the flow control member may block the orifice. The dissolvable support may comprise a second ball. The flow control member and dissolvable support may be arranged such that, when the control valve is in the first configuration, the dissolvable support prevents the flow control member from blocking the orifice; but when the control valve is in the second configuration, the flow control member is able to block the orifice. The flow control member may be moved from the first to the second position by fluid flow once the dissolvable support has dissolved.

The chamber may be arranged or shaped such that the dissolvable support can (when the control valve is in the first configuration) support the flow control member in an arrangement which does not obstruct an inlet or an orifice of the control valve. For example, the dissolvable support may locate the flow control member between the dissolvable support and a concave surface of the chamber.

The chamber and orifice may be arranged such that, when the control valve is in a second configuration, the flow control member is located over, or in, an orifice. The flow control member may be maintained in the second position due to fluid pressure.

The flow control member may be substantially cylindrical. The flow control member may be located within the chamber. The dissolvable support may be a castellated ring located around the orifice, or a ring with protrusions on a surface thereof in order to create channels therebetween. The flow control member may abut against the castellated surface when in a first position. When the control valve is in the first configuration, the flow control member and dissolvable support may be arranged such that fluid can flow through the gaps formed by the flow control member and the castellations and out of the orifice.

When the control valve is in the second configuration, the flow control member may close the orifice. That is, the flow control member closes the orifice when in the second position.

The flow control member may comprise a fluid port. The diameter of the fluid port may be smaller than that of the orifice. The flow control member and fluid port may be arranged such that fluid can flow through the fluid port in the flow control member and out of the orifice when the flow control member is in the second position. As such, fluid flow through the control valve may be reduced, but not prevented.

The flow control member may comprise a tubular sleeve. The tubular sleeve may be arranged concentrically with the base pipe. The orifice may be an orifice through the base pipe. The tubular sleeve may be arranged to move from a non-blocking to a blocking arrangement with respect to the orifice.

When in the first position, the tubular sleeve may be arranged such that fluid can flow through the orifice unimpeded. When in the second position the tubular sleeve may partially or entirely block the orifice. The tubular sleeve may move longitudinally with respect to the base pipe from a first position to a second position.

The downhole gravel packing apparatus, the tubular assembly, or the control valve may comprise a biasing member to bias the control valve from the first configuration to the second configuration. The biasing member may be arranged to bias the flow control member from the first position to the second position. The biasing member may comprise a spring. The spring may be arranged to longitudinally bias the tubular sleeve from the first position to the second position.

The fluid reactant arrangement may comprise a snap ring. The fluid reactant arrangement may comprise a snap ring and a dissolvable support (e.g. a dissolvable ring). The snap ring and dissolvable support may be arranged in an interface between the base pipe and the tubular sleeve to prevent relative movement of the tubular sleeve and the base pipe when the control valve is in the first configuration. The snap ring may prevent relative movement of the tubular sleeve and the base pipe. One of the snap ring and/or dissolvable support may be arranged to abut both the base pipe and tubular sleeve to prevent relative movement thereof when the control valve is in the first configuration. The snap ring and/or dissolvable support may be arranged in a circumferential groove in one of or both of the base pipe and tubular sleeve. The snap ring and/or dissolvable support may be arranged in circumferential grooves in the tubular sleeve and base pipe which are aligned when the control valve is in the first configuration.

The fluid reactant arrangement may comprise a snap ring and dissolvable support arranged in an interface between the base pipe and the tubular sleeve to prevent relative movement of the tubular sleeve and the base pipe when the control valve is in the first configuration; and the snap ring may be arranged such that, when the dissolvable support dissolves in the first fluid, the snap ring moves (e.g. by contracting or expanding) such that it is no longer preventing relative movement of the base pipe and tubular sleeve.

The snap ring may be arranged such that it is biased against the dissolvable support. The snap ring may be arranged such that, when the dissolvable support dissolves, the snap ring moves (e.g. by contracting or expanding) such that it is no longer preventing relative movement of the base pipe and tubular sleeve. The tubular sleeve may then be able to move from the first to the second position. The tubular sleeve may move from the first to the second position under the force of the biasing member.

The fluid reactant arrangement may comprise a material which swells in the first fluid. The fluid reactant arrangement may swell, or comprise a component which swells, from a first size to a second size in the first fluid.

The fluid reactant arrangement may swell in the presence of the first fluid, reconfiguring the control valve from the first to the second configuration. The fluid reactant arrangement may swell in the presence of the first fluid, moving the flow control member from a first to a second position. The fluid reactant arrangement may swell and consequently cease from maintaining the flow control member in the first position. The flow control member may therefore move from the first to the second position by means of flow through the control valve or under the action of a biasing member.

The fluid reactant arrangement may comprise a swellable member which, when exposed to the first fluid, swells to block a fluid path through the control valve.

The fluid reactant arrangement may comprise a swellable ring. The fluid reactant arrangement may comprise a snap ring and swellable ring. The snap ring and swellable ring may be arranged in an interface between the base pipe and the tubular sleeve such that the snap ring and/swellable ring prevent relative movement of the tubular sleeve and the base pipe. One of the snap ring and/or swellable ring may be arranged to abut both the base pipe and tubular sleeve to prevent relative movement thereof when the control valve is in the first configuration. The snap ring and/or swellable ring may be arranged in a circumferential groove in one of or both of the base pipe and tubular sleeve.

A downhole gravel packing apparatus may further comprise a base pipe arranged concentrically with the tubular sleeve; the orifice may be located in the base pipe; the fluid reactant arrangement may comprise a snap ring and a swellable ring arranged in an interface between the base pipe and the tubular sleeve to prevent relative movement of the tubular sleeve and the base pipe when the control valve is in the first configuration; and the snap ring may be arranged such that, when the swellable ring swells in the first fluid, the snap ring is moved to an arrangement such that it is no longer preventing relative movement of the base pipe and tubular sleeve.

The snap ring may be arranged such that, when the swellable ring expands, the snap ring is expanded or contracted such that it is no longer preventing relative movement of the base pipe and tubular sleeve. The tubular sleeve may then be able to move from the first to the second position. The tubular sleeve may move from the first to the second position under the force of the biasing member.

One of the fluid reactant ring (e.g. swellable ring or dissolvable support) and the snap ring may be located at least partially in a circumferential groove in the base pipe and the other of the fluid reactant ring and the snap ring may be located at least partially in a circumferential groove in the tubular sleeve.

When the control valve is in the first configuration, the snap ring may be located partially within a groove of the base pipe and partially within a groove of the tubular sleeve. As such, the snap ring may prevent relative movement of the tubular sleeve and base pipe and may prevent the control valve from reconfiguring to the second configuration.

Once the fluid reactant ring has reacted to the first fluid, the snap ring may move to be located within only one of the grooves in the tubular sleeve or the base pipe.

The first fluid may comprise the gravel pack carrier fluid.

The first fluid may comprise one of water, hydrocarbons and acid.

The first fluid may be any fluid and may be selected in order to provide the desired operation. The first fluid may be any fluid which could be found or injected into the wellbore in order to react with the fluid reactant arrangement. In selecting the first fluid and the fluid reactant arrangement, it must be considered when the control valve should reconfigure from the first to the second configuration and how quickly this must happen.

In some aspects, it may be desirable to keep the control valve in the first configuration until production starts. This may be achieved by using a fluid reactant arrangement which swells in the presence of a production fluid, in which case the production fluid would be the first fluid.

In other arrangements it may be desirable for the control valve to reconfigure to the second configuration a certain period of time after starting gravel packing. In this case it may be desirable to have a fluid reactant arrangement which dissolves in water after a certain period of time and use water as the gravel packing carrier fluid and thus the first fluid.

In other arrangements it may be desirable to be able to select specifically when the control valve should reconfigure to the second arrangement. In this case it may be desirable to select a fluid reactant material which swells or dissolves in a liquid that is not the gravel packing carrier fluid and is not naturally found in the wellbore. The operators can then select when to reconfigure the control valve and the first fluid can be injected at a specific time to react with the fluid reactant arrangement and reconfigure the control valve from the first configuration to the second configuration.

The downhole gravel packing apparatus may comprise or form part of a gravel pack completion.

An aspect of the present disclosure relates to a wellbore completion or gravel pack completion comprising the downhole gravel packing apparatus. The wellbore completion may comprise a plurality of gravel packing apparatuses.

The wellbore completion may comprise a plurality of downhole gravel packing apparatuses with the tubular assemblies connected in series.

The wellbore completion may comprise a zonal isolation packer. The packer may be a swellable packer. The gravel pack completion may comprise a packer at either end of the tubular assembly. The packer may be arranged adjacent a sand screen or ICD housing.

The wellbore completion may be installed in a deviated or horizontal wellbore.

In use, gravel may be located in the annulus between the tubular assembly and the formation. The gravel may be located between the sand screen and the formation.

The gravel pack completion may comprise gravel located in the annulus between the tubular assembly and the formation. The gravel may be located between the sand screen and the formation.

It is to be understood that the term gravel is used to describe any particulate matter, including but not limited to sand. The particulate matter may be of any size and grading, determined by the formation.

An aspect of the present disclosure relates to a downhole gravel packing control valve for use in controlling flow of a gravel pack carrier fluid during a gravel packing operation, the control valve comprising a fluid reactant arrangement which reacts with a first fluid to reconfigure the control valve from a first configuration in which flow through the control valve is permitted during a gravel packing operation, and a second configuration in which flow through the control valve is restricted.

It is to be understood that any discussion relating to features of the control valve of the downhole gravel packing apparatus (above) applies, mutatis mutandis, to the aspect of the present disclosure relating to a downhole gravel packing control valve.

An aspect of the present disclosure relates to a downhole apparatus, comprising:

- a tubular assembly for being arranged within a wellbore to define an annulus between said tubular assembly and a wall of the wellbore; and
- a control valve provided within the tubular assembly to control flow of a fluid between external and internal regions of the tubular assembly, the control valve comprising a fluid reactant arrangement which reacts with a first fluid to reconfigure the control valve from a first configuration in which flow through the control valve is permitted, and a second configuration in which flow through the control valve is restricted.

It is to be understood that any discussion relating to features of the downhole gravel packing apparatus applies, mutatis mutandis, to the aspect of the present disclosure relating to a downhole apparatus.

An aspect of the present disclosure relates to a control valve for use in controlling flow of a fluid, the control valve comprising a fluid reactant arrangement which reacts with a first fluid to reconfigure the control valve from a first configuration in which flow through the control valve is permitted, and a second configuration in which flow through the control valve is restricted.

It is to be understood that any discussion relating to features of the control valve of the downhole gravel packing apparatus applies, mutatis mutandis, to the aspect of the present disclosure relating to a control valve.

An aspect of the present disclosure relates to a method for gravel packing, comprising:

- providing a tubular assembly, or a downhole gravel packing apparatus (which may be according to an apparatus of the present disclosure) comprising a tubular assembly, within a wellbore to define an annulus between said tubular assembly and a wall of the wellbore, wherein the tubular assembly includes a control valve (which may be according to a control valve of the present disclosure) configured in a first configuration;
- delivering a slurry of gravel and a carrier fluid into the annulus;
- permitting the carrier fluid to enter the tubular assembly via the control valve to retain the gravel within the annulus;
- exposing a fluid reactant arrangement of the control valve to a first fluid to cause the control valve to be reconfigured to a second configuration in which further flow through the control valve is restricted.

It is to be understood that the use of any of the apparatus features described above may form part of the aspect of the present disclosure relating to a method for gravel packing.

The method for gravel packing may be used to set up a gravel pack as a sand control solution in wells with weak sandstone regions, in order to minimise the production of sand with the hydrocarbons.

The control valve may be reconfigured from a first to a second configuration. In the first configuration, fluid may be able to flow through the control valve at a first rate. The first flow rate may be a high flow rate. A high flow rate may help to reduce, or manage, the pressure increase within the annulus during gravel packing, since maximum potential fluid return flow is maximised, thus minimising the pressure gradient from the interior to the exterior of the tubular housing.

In the second configuration, fluid may be able to flow through the control valve at a second rate. The second flow rate may be lower than the first flow rate. In reconfiguring from the first to the second configuration, the control valve may restrict flow through the control valve.

The control valve may be reconfigured to increase the pressure drop across the control valve.

In the second configuration, the control valve may be closed. Exposing a fluid reactant arrangement of the control valve to a first fluid may cause the control valve to be reconfigured to a second configuration in which further flow through the control valve is prevented. Exposing a fluid reactant arrangement of the control valve to a first fluid may cause the control valve to close. Exposing a fluid reactant arrangement of the control valve to a first fluid may cause the control valve to become a non-return valve (NRV).

Exposing a fluid reactant arrangement of the control valve to a first fluid may cause the control valve to close and force fluid to enter the tubular assembly via an alternative route.

Fluid may be permitted to enter the tubular assembly via an inflow control device. Exposing a fluid reactant arrangement of the control valve to a first fluid may cause the control valve to close and force fluid to enter the tubular assembly via an inflow control device (ICD). Thus pressure in the annulus may be controlled by means of the ICD.

Reconfiguring the control valve from a first configuration to a second configuration may cause the maximum permissible flow rate from the exterior to the interior of the tubular assembly to reduce. Reconfiguring the control valve from a first configuration to a second configuration may increase the pressure drop induced by the control valve. Reconfiguring the control valve from a first configuration to a second configuration may increase the pressure difference between the exterior and interior of the tubular assembly.

Exposing a fluid reactant arrangement of the control valve to a first fluid may cause the control valve to become an ICD, or act as an ICD.

The carrier fluid may enter the tubular assembly via the sand screen and control valve.

The carrier fluid may enter a base pipe which forms part of the tubular assembly.

The control valve is reconfigured from the first configuration to the second configuration by the fluid reactant arrangement. The fluid reactant arrangement reacts to a first fluid to reconfigure the control device from the first configuration to a second configuration.

The control valve may comprise a flow control member and an orifice. Fluid may flow through the control valve via the orifice.

When the control valve is in the first configuration, the flow control member may be in a first position and fluid may flow through the orifice. When the control valve is being reconfigured to the second configuration, the flow control member may move to a second position and may restrict flow through the orifice.

The control valve may comprise a flow control member and an orifice and when the control valve is being reconfigured from the first configuration to the second configuration, the flow control member may move from a first position to a second position. In the second position, the flow control member may obscure, cover, or impede the orifice. When in the second position, the flow control member may block the orifice and/or prevent fluid flow through the orifice.

The fluid reactant arrangement may comprise a material which dissolves in the first fluid. The fluid reactant arrangement may partially, or fully, dissolve when exposed to the first fluid.

The fluid reactant arrangement may comprise a dissolvable support. The dissolvable support may hold the control valve in the first configuration. The dissolvable support may dissolve in the first fluid and cause the control valve to be reconfigured to the second configuration.

The dissolvable support may hold the flow control member in the first position (when the control valve is in the first configuration). When exposed to the first fluid, the dissolvable support may dissolve and the flow control member may move to the second position.

The dissolvable support may take a prolonged period to dissolve. The control valve may only reconfigure from the first to the second configuration once the fluid reactant arrangement has finished reacting to the first fluid (e.g. once the dissolvable support has totally dissolved).

Fluid flowing through the control valve may flow through a chamber in the control valve. Fluid flowing through the control valve may flow into the chamber and out of an orifice. The flow control member may be located within the chamber.

The flow control member may be a ball trapped in the chamber. In the first position, the flow control member may not impede flow through the orifice. Fluid may flow through the control valve unimpeded when the control valve is in the first configuration. In the second position, the flow control member may block the orifice. The dissolvable support may comprise a second ball. When the control valve is in the first configuration, the dissolvable support may prevent the flow control member from blocking the orifice; but when the control valve is in the second configuration, the flow control member may block the orifice. The flow control member may be moved from the first to the second position by fluid flow once the dissolvable support has dissolved.

The flow control member may abut against a castellated surface when in a first position. When the control valve is in the first configuration, fluid may flow through the gaps formed by the flow control member and the castellations and out of the orifice.

When the control valve is in the second configuration, the flow control member may close the orifice. That is, the flow control member closes the orifice when in the second position.

Fluid flow may be permitted through a fluid port in the flow control member when the flow control member is in the second position. When the flow control member is in the second position, fluid may be able to flow through the fluid port in the flow control member and out of the orifice. As such, fluid flow through the control valve may be reduced, but not prevented.

The flow control member may be a tubular sleeve. The orifice may be in a base pipe arranged concentrically with the tubular sleeve The tubular sleeve may move longitudinally with respect to the base pipe from a first position (in the first configuration) to a second position (in the second configuration).

A biasing member may bias the flow control member from the first position to the second position.

The fluid reactant arrangement may comprise a snap ring and dissolvable support. The snap ring and/or dissolvable support may prevent relative movement of the tubular sleeve and the base pipe when in the first configuration.

When the fluid reactant arrangement is exposed to a first fluid, the dissolvable support may dissolve and—once the fluid reactant arrangement has finished reacting to the first fluid—the snap ring may move out of a blocking position (e.g. by contracting or expanding due to its internal resilience) such that it is no longer preventing relative movement of the base pipe and tubular sleeve. The tubular sleeve may then move from the first to the second position. The tubular sleeve may move from the first to the second position under the force of the biasing member.

The fluid reactant arrangement may comprise a material which may swell in the presence of the first fluid. The fluid reactant arrangement may swell in the presence of the first fluid, reconfiguring the control valve from a first to a second configuration. The fluid reactant arrangement may swell in the presence of the first fluid, moving the flow control member from a first to a second position. The fluid reactant arrangement may swell and consequently cease from maintaining the flow control member in the first position. The flow control member may therefore move from the first to the second position by means of flow through the control valve or under the action of a biasing member.

The fluid reactant arrangement may comprise a snap ring and a swellable ring. One or both of the snap ring and swellable ring may prevent relative movement of the tubular sleeve and the base pipe when the control valve is in a first configuration. When the fluid reactant arrangement is exposed to a first fluid, the swellable ring swells and move the snap ring out of a blocking position such that it is no longer preventing relative movement of the base pipe and tubular sleeve.

The tubular sleeve may then move from the first to the second position.

The tubular sleeve may move from the first to the second position under the action of a biasing member.

An aspect of the present disclosure relates to a method for controlling fluid production in a wellbore, comprising:

- providing a tubular assembly, or a downhole gravel packing apparatus (which may be according to an aspect of this disclosure), within a wellbore to define an annulus between said tubular assembly and a wall of the wellbore, wherein the tubular assembly includes a control valve (which may be according to an aspect of this disclosure) configured in a first configuration;
- permitting a fluid to enter the tubular assembly via the control valve;
- exposing a fluid reactant arrangement of the control valve to a first fluid to cause the control valve to be reconfigured to a second configuration in which further flow through the control valve is restricted.

BRIEF DESCRIPTION OF DRAWINGS

Examples of the present disclosure will now be provided with reference to the following figures.

DETAILED DESCRIPTION OF THE DRAWINGS

Figure 1:
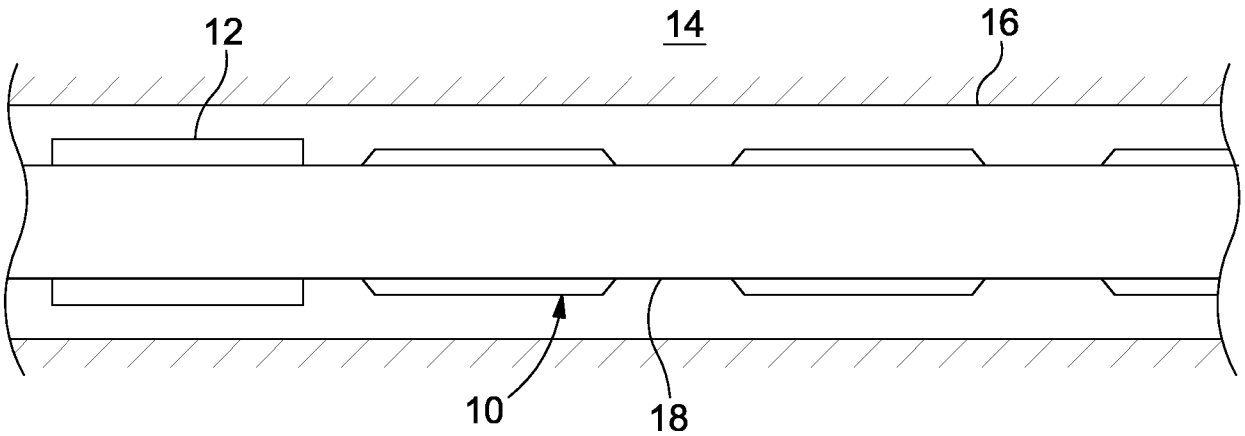
FIG. 1 is a schematic cross section view of a wellbore completion according to the present disclosure.

FIG. 1 shows a wellbore completion. A wellbore 16 has been drilled through foundation 14. A downhole gravel packing apparatus 10 comprising a tubular assembly 18 is located in the wellbore 16. The wellbore completion also comprises a zonal isolation packer 12.

FIG. 1 illustrates how the annulus surrounding the unexpanded packer 12 is smaller than that surrounding the downhole gravel packing apparatus 10. Aspects according to the present disclosure provide more control over annular velocities during gravel packing and annulus pressures both before and after gravel packing, to help provide a good quality gravel pack while maintaining effective zonal isolation.

Figure 2A:
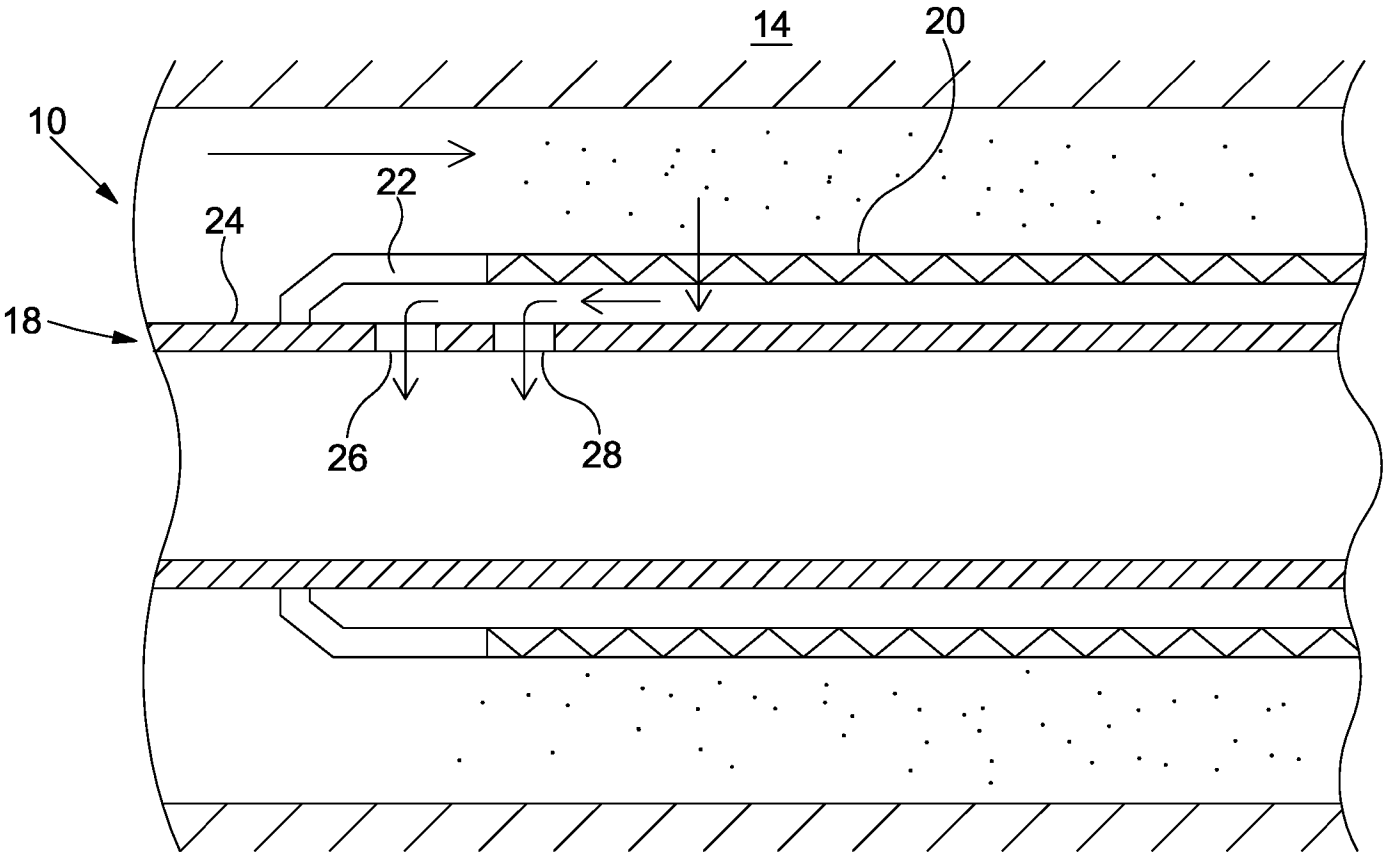
FIG. 2A is a schematic cross section view of a downhole gravel packing apparatus according to the present disclosure with a control valve in a first configuration.

FIG. 2A shows a downhole gravel packing apparatus 10 in a wellbore during gravel packing. The gravel packing apparatus comprises a sand screen 20 connected to ICD housing 22. The tubular assembly 18 of the apparatus 10 comprises a base pipe 24 via which fluid can reach the surface. The sand screen 20 is arranged to circumscribe the base pipe 24 in a traditional manner and thereby defines a screen annulus between the sand screen 20 and the base pipe 24. An ICD 26 and a control valve 28 are located in parallel in the base pipe 24. The control valve 28 is in a first configuration in which fluid may flow through the control valve 28 between internal and external regions of the tubular assembly.

During gravel packing, a slurry of fluid and gravel is pumped into the annulus formed by the tubular assembly 18 and the wellbore. The arrows show the movement of the fluid. The fluid enters the screen annulus formed between the sand screen 20 and the base pipe 24 via the sand screen 20; travels along this annulus; and enters the interior of the base pipe 24 to travel to the surface via the inflow control device (ICD) 26 and the control valve 28.

The control valve 28 provides an additional route (in addition to the ICD) by which the gravel pack carrier fluid can enter the base pipe 24. Accordingly, the pressure build up in the annulus during gravel packing is less than it would be in the absence of the control valve 28.

Figure 2B:
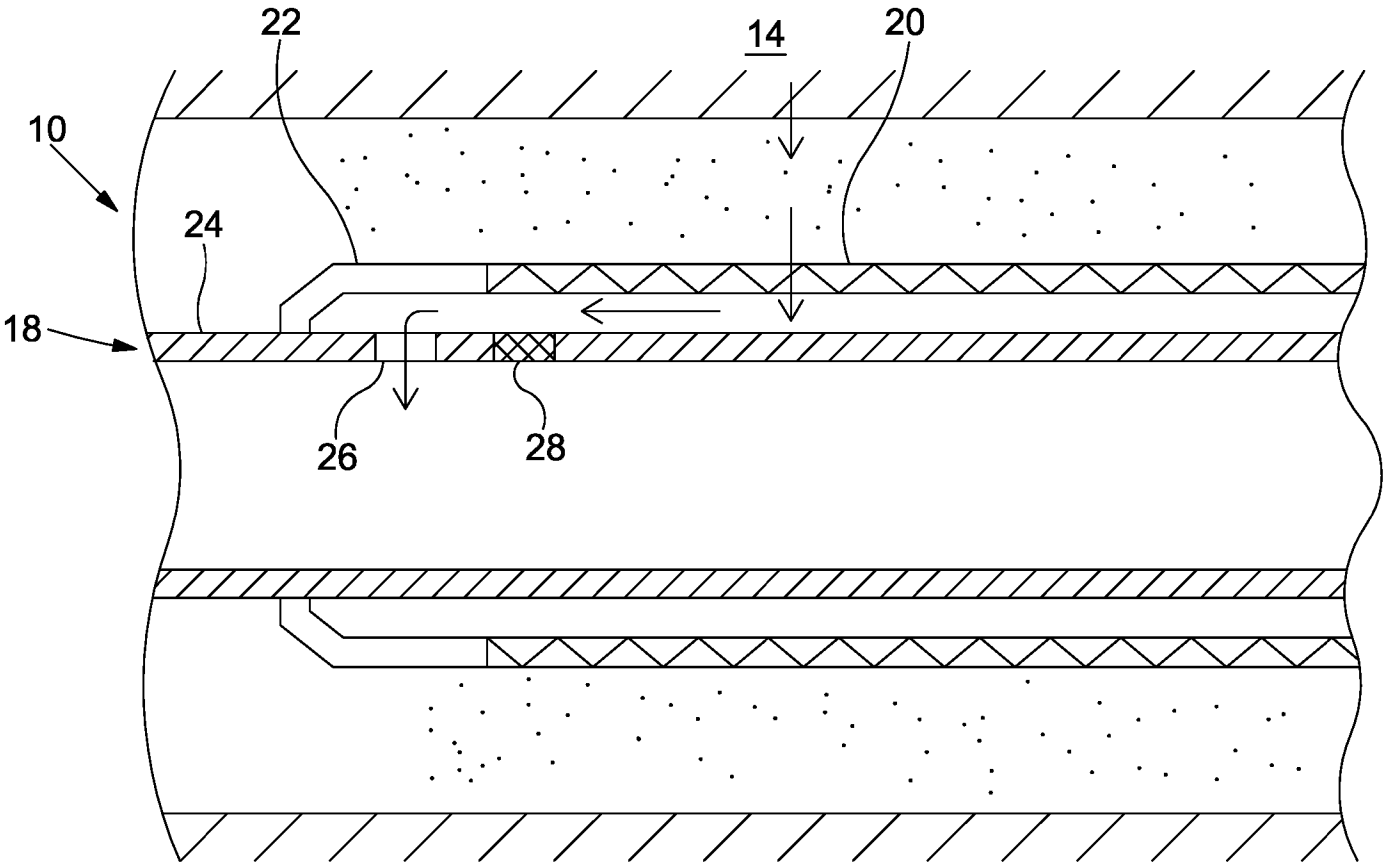
FIG. 2B is a schematic cross section view of a downhole gravel packing apparatus according to the present disclosure with a control valve in a second configuration.

FIG. 2B shows the downhole gravel packing apparatus of FIG. 2A, after a fluid reactant arrangement (not shown) has reacted with a first fluid, causing the control valve 28 to reconfigure to a second configuration.

The fluid reactant arrangement may react in any of a plurality of ways. For example it may swell, dissolve, distort, or a combination of any of these. This reaction causes the control valve to go from a first configuration to a second configuration.

The first fluid may be any fluid and may be selected in order to provide the desired operation. The first fluid may be oil, water, acid, fluid carrier fluid or any other fluid which could be found or injected into the wellbore in order to react with the fluid reactant arrangement.

In the second configuration, the control valve 28 of FIGS. 2A and 2B is closed and no fluid flow can pass therethrough. As such, the only route into the base pipe 24 and to the surface is through the ICD 26. This configuration may be used during production. The fluid path is shown in arrows. The fluid enters the screen annulus via sand screen 20; travels along the screen annulus and enters the base pipe 24 via the ICD 26.

The pressure in the annulus can now be controlled by means of the ICD 26 (since the control valve 28 does not provide a fluid flow path). Accordingly, the pressure in the annulus can be set to balance wellbore production using known techniques.

As has been demonstrated by the above discussion, the present disclosure allows pressures within the annulus to be managed (i.e. kept low enough to avoid formation fracturing) during gravel packing, but then allows the pressure to be maintained at the desired level (i.e. a chosen level to balance production) during production. This is achieved by providing an additional flow path (through the control valve 28) which can be active during gravel packing, but then is automatically restricted or closed before, or during, production.

Figure 3:
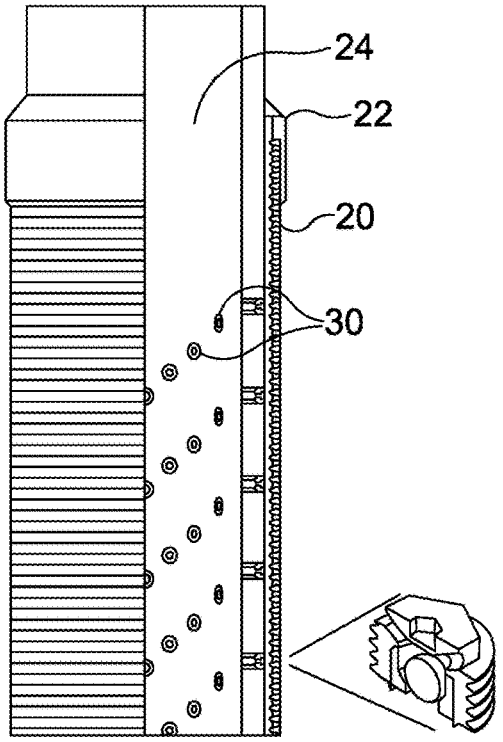
FIG. 3 is a partial cut-away view of a downhole gravel packing apparatus according to the present disclosure.

FIG. 3 shows a further aspect of the present disclosure. Similarly to the embodiment of FIGS. 2A and 2B, the downhole gravel packing apparatus of FIG. 3 comprises a tubular assembly comprising a base pipe 24 and sand screen 20. The apparatus of FIG. 3 also includes a sand screen end ring 22 and a plurality of control valves 30. The downhole gravel packing apparatus of FIG. 3 may be used in water injection applications. In order to gravel pack with the apparatus of FIG. 3 in the string, the control valves 30 are held in a first configuration to permit flow through the control valve. Each control valve 30 (when open) provides a flow path for fluid to enter the base pipe 24 from the screen annulus.

Having a large number of control valves 30 in the base pipe 24 increases the maximum flow rate into the base pipe 24 and hence minimises the pressure in the annulus during gravel packing.

Each of the control valves 30 in FIG. 3 provides a fluid path into the base pipe 24 when in a first configuration, but is shut off and does not allow fluid flow in either direction when in a second configuration.

The control valves 30 of FIG. 3 comprise an inlet and orifice with a central chamber. A flow control member in the form of a sphere is present in the central chamber and is surrounded by the fluid reactant arrangement which comprises a swellable material. When the fluid reactant arrangement reacts with the first fluid, it expands, filling the area surrounding the flow control member and thus preventing fluid from flowing through the chamber. Since the sphere is held in place by the swellable material, flow is prevented in both directions through the control valve 30.

Figure 4:
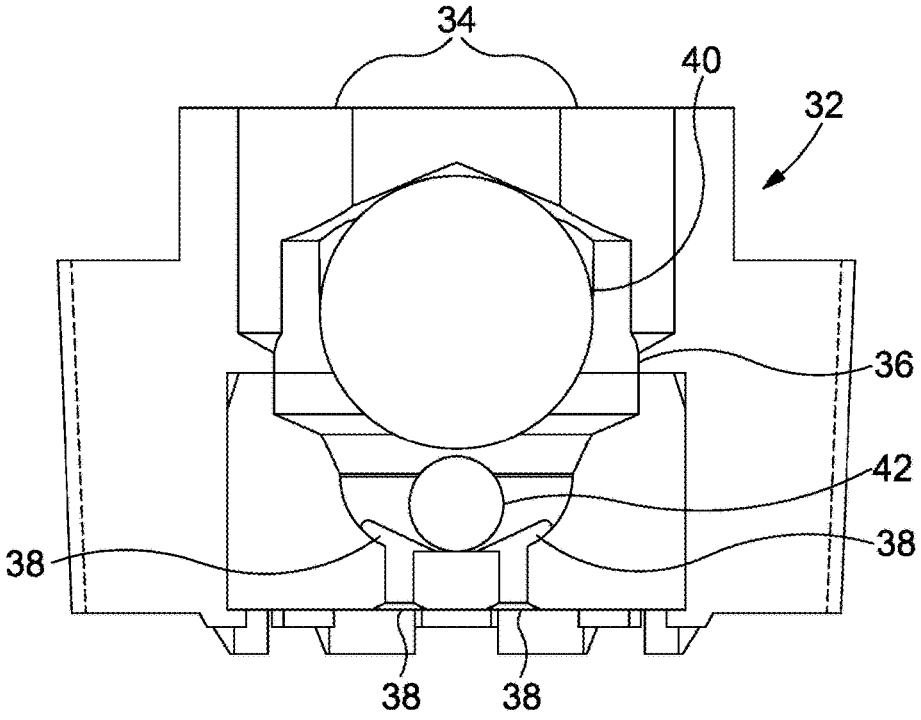
FIG. 4 is a schematic cross section view of a control valve according to the present disclosure.

FIG. 4 is a cross section of a control valve 32 which may be used in an aspect according to the present disclosure, shown in a first configuration.

The control valve 32 of FIG. 4 would normally be installed in a base pipe 24 such that gravel packing carrier fluid enters the control valve from the top, and exits from the bottom of the figure. The control valve 32 of FIG. 4 could be used in place of the control valves 30 in the embodiment of FIG. 3.

The control valve 32 comprises a plurality of inlets 34 which lead to a chamber 36. In other embodiments a single inlet 36 may be provided. A plurality of orifices 38 lead from the chamber to allow fluid to exit the chamber 36 and the control valve 32. The plurality of orifices 38 are outlets from the control valve 32 and are not designed to create a pressure drop. In other embodiments a single orifice might be provided. A flow control member in the form of a ball 40 is entrapped within the chamber 36. A dissolvable support, in the form of a second ball 42, is also entrapped within the chamber 36. In the first configuration, as shown in FIG. 4, the dissolvable support ball 42 is located adjacent the orifices 38 but, due to the size and arrangement of the dissolvable support ball 42, it is unable to block fluid from passing through the orifices. Flow control member ball 40 is located above (i.e. upstream when gravel packing carrier fluid is entering the base pipe from the annulus) dissolvable support ball 42 and, in the embodiment of FIG. 4, has a much larger diameter than the dissolvable support ball 42. Dissolvable support ball 42 supports flow control member ball 40 in a position which does not obstruct the inlets 34 or the orifices 38—wedged between the dissolvable support ball 42 and a concave surface in the chamber 36. As such, fluid can enter the inlets 34 and leave the orifices 38 of the control valve 32.

The dissolvable support ball 42 dissolves when the dissolvable support ball 42 comes into contact with the first fluid. As the support ball 42 dissolves, the control valve 32 reconfigures into the second configuration. In doing so, the flow member ball 40 is moved towards the orifices 38 due to the motion of the surrounding fluid. Flow control member ball 40 then sits in the curved lower surface of chamber 36 and blocks both orifices 38, thereby preventing fluid from flowing through the control valve 32.

Aspects of the present disclosure are not limited to the geometry of the embodiment of FIG. 4. It is to be understood that in other embodiments the support ball 40 and dissolvable ball 42 may have other relative sizes or may be non-spherical in shape.

Figure 5:
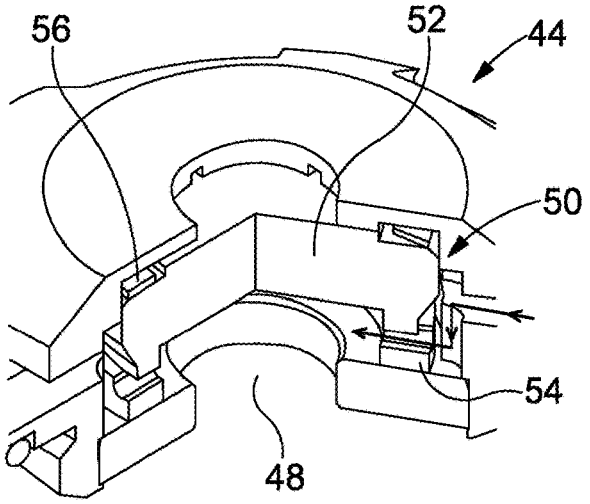
FIG. 5 is a partial cut-away view of a control valve according to the present disclosure.

FIG. 5 illustrates an alternative control valve 44 according to an aspect of this disclosure.

The control valve 44 of FIG. 5 is of the type that can be used in a production configuration with an ICD, located on the inside of the sand screen. The control valve 44 may therefore be arranged to be located in parallel with an ICD, providing access to the production tubing. The control valve 44 of FIG. 5 is suitable for use as the control valve 28 in FIGS. 2A and 2B, or the control valves 30 in FIG. 3.

The control valve 44 in FIG. 5 is shown in the first configuration.

The control valve 44 of FIG. 5 comprises inlets (not shown) around the circumference of the valve 44 which lead to a chamber 50. Inlets allow fluid to pass into the chamber 50 radially through passages illustrated with arrows in FIG. 5. The control valve 44 has a circular orifice 48 at the base of the chamber 50. A flow control member in the form of a cylinder or disc 52 is located within the chamber 50. A biasing member 56 acts on the upper surface of the disc 52, biasing the disc 52 towards the orifice 48.

Figure 6:
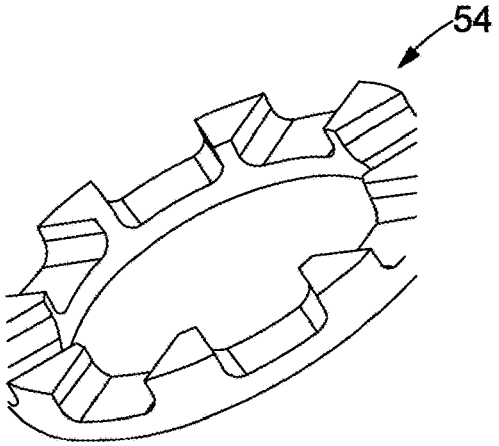
FIG. 6 is a perspective view of a fluid reactant arrangement according to the present disclosure.

In between the disc 52 and the orifice 48 is a dissolvable support in the form of a ring 54 with castellations, or protrusions, forming channels in the upper surface thereof. The ring 54 is shown in FIG. 6. When the control valve 44 is in the first configuration, fluid can reach the orifice 48 by travelling through channels formed between the castellated surface of the ring 54 and the lower surface of the disc 52.

When the dissolvable support member (ring 54) has finished reacting to the first fluid, that is, once the ring 54 has dissolved, biasing member 56 moves the disc 52 towards the orifice 48. This is the reconfiguring of the control valve 44 from the first to the second configuration. Once the disc 52 reaches the bottom of the chamber 50, it seals the orifice 48, thus preventing fluid from travelling through the control valve 44. The control valve 44 is then in the second configuration.

Figure 7:
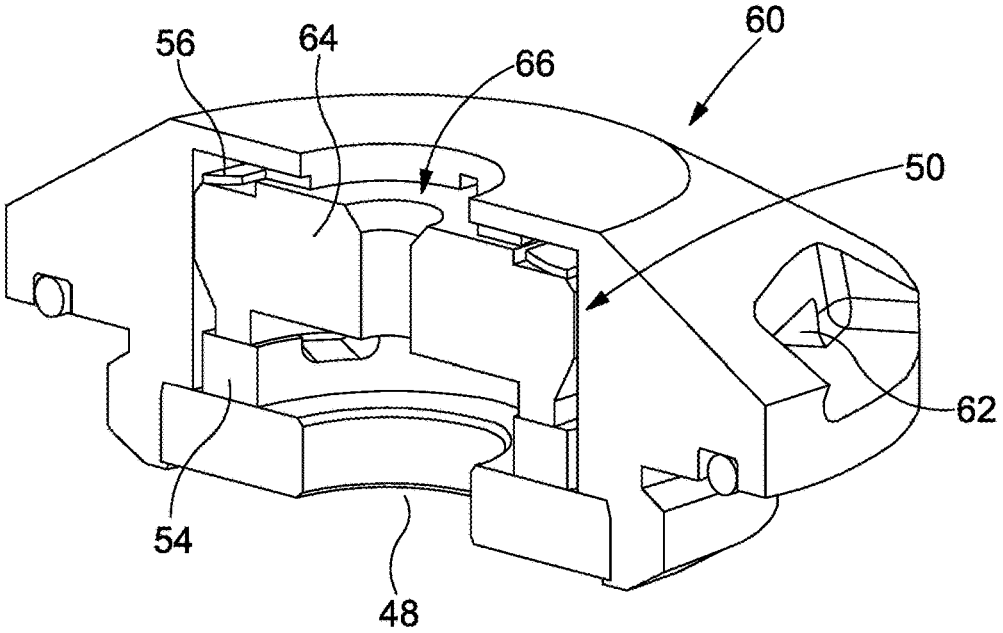
FIG. 7 is a perspective sectional view of a control valve according to the present disclosure.

FIG. 7 shows a further example of a control valve 60 according to an aspect of the present disclosure. The housing, inlets 62 (now shown), chamber 50, ring 54, biasing member 56 and orifice 48 of the control valve 60 of FIG. 7 are the same as in FIG. 6 and so will not be discussed.

The flow control member of FIG. 7 is substantially a disc 64. The disc 64 comprises a central fluid port 66. The diameter of the central fluid port 66 is less than the diameter of the orifice 48. The fluid port 66 allows fluid to flow through the disc 64.

When the control valve 60 is in the first configuration, fluid port 66 provides an extra fluid pathway through the control valve 60.

When the control valve 60 is in the second configuration (reconfiguration of the control valve is discussed with reference to FIG. 5), fluid can flow through the control valve 60 via fluid port 66. As such, fluid flow through the control valve 60 is restricted when the control valve 60 is reconfigured to the second configuration, rather than prevented. The control valve 60 therefore acts as an ICD when in the second configuration.

It may therefore be possible to use control valves 60 as illustrated in FIG. 7 in a downhole gravel packing apparatus without a separate ICD—as the control valve can provide a large flow path when in the first configuration, and then restrict (but not eliminate) the flow path when in the second configuration.

Figure 8:
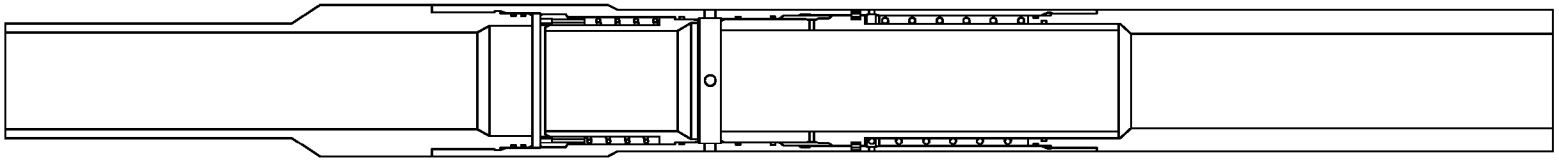
FIG. 8 is a schematic cross section view of a downhole gravel packing apparatus according to the present disclosure.
Figure 9:
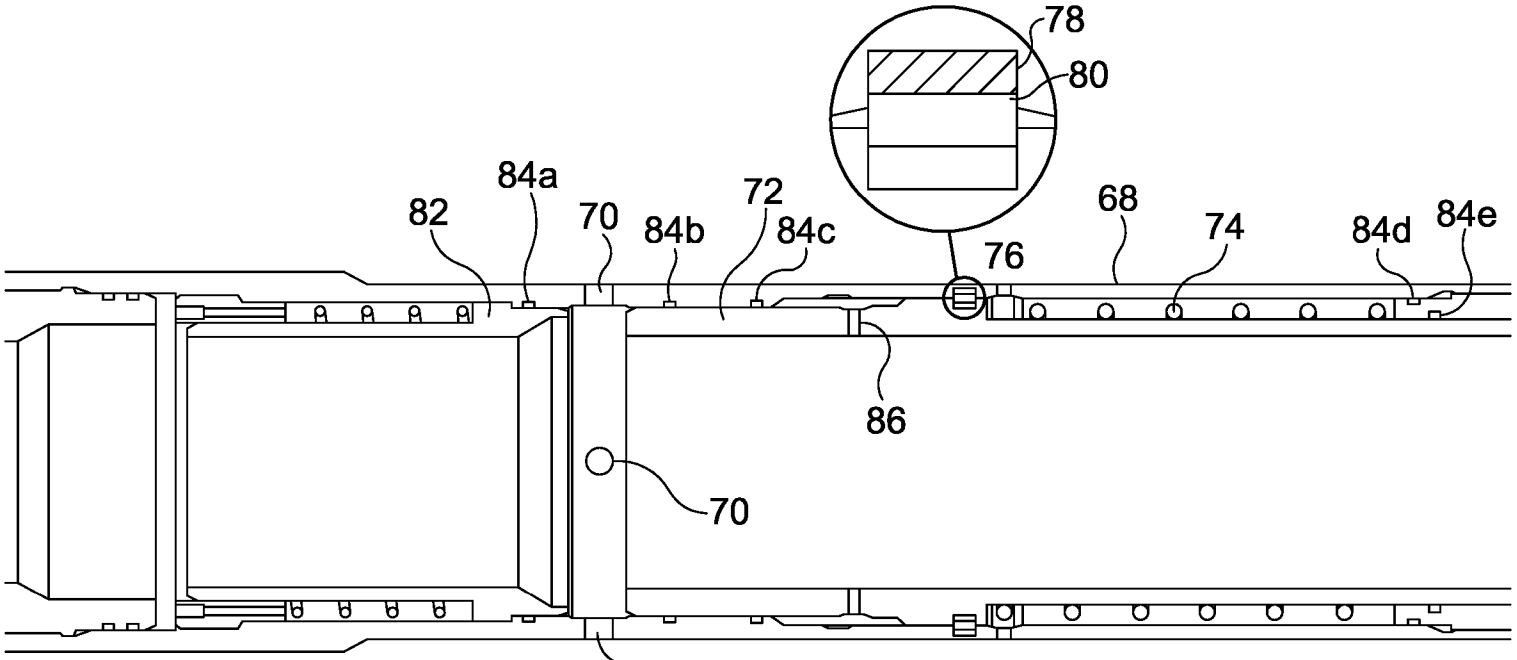
FIG. 9 is an enlarged view of FIG. 8.

FIGS. 8 and 9 illustrate a further downhole gravel packing apparatus according to an aspect of the present disclosure. FIG. 9 is an enlarged view of part of FIG. 8.

The downhole gravel packing apparatus of FIGS. 8 and 9 comprises a base pipe 68 for transporting fluids to the surface. A control valve of the downhole gravel packing apparatus comprises a flow control member 72 in the form of a tubular sleeve 72 which is located concentrically inside the base pipe 68. The control valve also comprises orifices 70 arranged through the base pipe 68 to allow fluid to enter the base pipe 68. Tubular sleeve 72 is arranged to move between a first position (as shown in FIGS. 8 and 9) in which fluid may flow through the orifices 70, and a second position in which it blocks the orifice and prevents fluid flow therethrough. The control valve is in a first configuration when the tubular sleeve 72 is in the first position and a second configuration when the tubular sleeve 72 is in the second position.

Tubular sleeve 72 is acted upon by a biasing member in the form of a spring 74. The spring 74 biases the tubular sleeve 72 from the first position to the second position.

Fluid reactant arrangement 76 comprises a swellable ring 78 and a snap ring 80, located at the interface between the base pipe 68 and the tubular sleeve 72. Swellable ring 78 is located at least partially in a circumferential groove in the base pipe 68 and the snap ring is located in a circumferential groove in the tubular sleeve 72.

When the control valve is in the first configuration, as shown in FIGS. 8 and 9, the snap ring is located partially within the groove of the base pipe 68 and partially within the groove of the tubular sleeve 72. As such, the snap ring 80 prevents relative movement of the tubular sleeve 72 and base pipe 68 and prevents the control valve from reconfiguring to the second configuration.

When the swellable ring 78 is exposed to the first fluid, it will swell. As the swellable ring 78 expands, it forces the snap ring 80 to contract. Once the snap ring 80 has contracted such that it is no longer partially located in grooves of both the tubular sleeve 72 and the base pipe 68 (i.e. once the snap ring 80 no longer protrudes into the groove of the base pipe 68), the tubular sleeve 72 is free to move relative to the base pipe 68. The control valve therefore reconfigures from the first to the second configuration as the spring 74 moves the tubular sleeve to a position where it covers the orifices 70.

The downhole gravel packing apparatus of FIGS. 8 and 9 also includes a secondary sleeve 82 which is biased towards the tubular sleeve 72. The purpose of secondary sleeve 82 (and its associated spring) is to protect O-ring 84*a*. Several O-rings 84 are located in the downhole gravel packing apparatus in order to ensure adequate fluidic performance.

Fluid channels 86 are located through the tubular sleeve 72 in order to allow fluid to escape from gaps between the tubular sleeve 72 and the base pipe 68 in order to avoid a build-up of pressure. Fluid channels 86 also provide access to the fluid reactant arrangement 76, such that the fluid reactant arrangement 76 can come into contact with the first fluid.

The present invention has been described above purely by way of example. Modifications in detail may be made to the present invention within the scope of the claims as appended hereto.

The invention claimed is:

1. A downhole gravel packing apparatus, comprising:

a tubular assembly for being arranged within a wellbore to define an annulus between said tubular assembly and a wall of the wellbore; and a control valve provided within the tubular assembly to control flow of a gravel pack carrier fluid between external and internal regions of the tubular assembly, the control valve comprising a fluid reactant arrangement which reacts with a first fluid to reconfigure the control valve from a first configuration in which flow through the control valve is permitted during a gravel packing operation, and a second configuration in which flow through the control valve is restricted;

wherein the downhole gravel packing apparatus comprises a sand screen and a base pipe;

wherein the sand screen circumscribes the base pipe and defines a screen annulus between the sand screen and the base pipe, the screen annulus being arranged such that fluid may enter the screen annulus from the annulus via the sand screen;

wherein the control valve is located in the base pipe to permit flow from the screen annulus into the interior of the base pipe.

2. The downhole gravel packing apparatus according to claim 1, further comprising an inflow control device arranged parallel to the control valve.

3. The downhole gravel packing apparatus according to claim 1, wherein the fluid reactant arrangement comprises a dissolvable support arranged to hold the control valve in the first arrangement, said dissolvable support comprising a material which dissolves in the first fluid.

4. The downhole gravel packing apparatus according to claim 1, wherein the control valve comprises a flow control member and an orifice; wherein when the control valve is in the first configuration, the flow control member is in a first position and fluid may flow through the orifice; and when the control valve is in the second configuration, the flow control member is in a second position and restricts flow through the orifice.

5. The downhole gravel packing apparatus according to claim 4, wherein the fluid reactant arrangement is arranged to hold the flow control member in the first position when the control valve is in the first configuration.

6. The downhole gravel packing apparatus according to claim 5, wherein the control valve comprises a chamber arranged such that fluid flowing through the control valve flows through the chamber and out of the orifice, wherein the flow control member is trapped in the chamber and the fluid reactant arrangement comprises a dissolvable support.

7. The downhole gravel packing apparatus according to claim 6, wherein the flow control member is a ball and the dissolvable support is a second ball.

8. The downhole gravel packing apparatus according to claim 5, wherein the control valve comprises a chamber arranged such that fluid flowing through the control valve flows through the chamber and out of the orifice; wherein the fluid reactant arrangement comprises a dissolvable support in the form of a castellated ring located around the orifice; and in the first configuration, the flow control member and dissolvable support are arranged such that fluid can flow through gaps formed by the flow control member and the castellations and out of the orifice.

9. The downhole gravel packing apparatus according to claim 4, wherein the flow control member comprises a fluid port and the flow control member and fluid port are arranged such that fluid can flow through the fluid port in the flow control member and out of the orifice when the flow control member is in the second position.

10. The downhole gravel packing apparatus according to claim 4, wherein the flow control member comprises a tubular sleeve.

11. The downhole gravel packing apparatus according to claim 10, wherein the base pipe arranged concentrically with the tubular sleeve; wherein the orifice is located in the base pipe; the fluid reactant arrangement comprises a snap ring and dissolvable support arranged in an interface between the base pipe and the tubular sleeve to prevent relative movement of the tubular sleeve and the base pipe when the control valve is in the first configuration; and the snap ring is arranged such that, when the dissolvable support dissolves in the first fluid, the snap ring moves such that it is no longer preventing relative movement of the base pipe and tubular sleeve.

12. The downhole gravel packing apparatus according to claim 10, wherein the base pipe arranged concentrically with the tubular sleeve; wherein the orifice is located in the base pipe; the fluid reactant arrangement comprises a snap ring and a swellable ring arranged in an interface between the base pipe and the tubular sleeve to prevent relative movement of the tubular sleeve and the base pipe when the control valve is in the first configuration; and the snap ring is arranged such that, when the swellable ring swells in the first fluid, the snap ring is moved to an arrangement such that it is no longer preventing relative movement of the base pipe and tubular sleeve.

13. The downhole gravel packing apparatus according to claim 1, wherein the fluid reactant arrangement comprises a material which swells in the first fluid.

14. The downhole gravel packing apparatus according to claim 1, wherein the first fluid comprises one of: the gravel pack carrier fluid, water, acid and oil.

15. A method for gravel packing, comprising:

providing a downhole gravel packing apparatus comprising a tubular assembly, within a wellbore to define an annulus between said tubular assembly and a wall of the wellbore, wherein the tubular assembly includes a control valve configured in a first configuration, wherein the downhole gravel packing apparatus comprises a sand screen and a base pipe, wherein the sand screen circumscribes the base pipe and defines a screen annulus between the sand screen and the base pipe, the screen annulus being arranged such that fluid may enter the screen annulus from the annulus via the sand screen, wherein the control valve is located in the base pipe to permit flow from the screen annulus into the interior of the base pipe;

delivering a slurry of gravel and a carrier fluid into the annulus;

permitting the carrier fluid to enter the tubular assembly via the control valve to retain the gravel within the annulus;

exposing a fluid reactant arrangement of the control valve to a first fluid to cause the control valve to be reconfigured to a second configuration in which further flow through the control valve is restricted.

16. The method according to claim 15, further comprising permitting fluid to enter the tubular assembly via an inflow control device.

17. The method according to claim 15, wherein the control valve comprises a flow control member and an orifice and when the control valve is being reconfigured from the first configuration to the second configuration, the flow control member moves from a first position to a second position and restricts flow through the orifice.

18. The method according to claim 17, wherein the fluid reactant arrangement comprises a dissolvable support which holds the flow control member in the first position when the control valve is in the first configuration; and when the dissolvable support is exposed to a first fluid, the dissolvable support dissolves and the flow control member moves from a first position to a second position.

19. The method according to claim 18, wherein fluid flow is permitted through a fluid port in the flow control member when the flow control member is in the second position.

20. The method according to claim 17, wherein the flow control member is a tubular sleeve and the orifice is in the base pipe arranged concentrically with the tubular sleeve; the fluid reactant arrangement comprises a snap ring and a dissolvable support and prevents relative movement of the tubular sleeve and the base pipe when the control valve is in a first configuration; wherein when the fluid reactant arrangement is exposed to a first fluid, the dissolvable support dissolves and the snap ring moves out of a blocking position such that it is no longer preventing relative movement of the base pipe and tubular sleeve.

21. The method according to claim 20, further comprising moving the tubular sleeve from a first position to a second position under the action of a biasing member.

22. The method according to claim 17, wherein the flow control member is a tubular sleeve and the orifice is in the base pipe arranged concentrically with the tubular sleeve; the fluid reactant arrangement comprises a snap ring and a swellable ring and prevents relative movement of the tubular sleeve and the base pipe when the control valve is in a first configuration; wherein when the fluid reactant arrangement is exposed to a first fluid, the swellable ring swells and moves the snap ring out of a blocking position such that it is no longer preventing relative movement of the base pipe and tubular sleeve.

23. The method according to claim 22, further comprising moving the tubular sleeve from a first position to a second position under the action of a biasing member.

24. The method according to claim 15, wherein the fluid reactant arrangement comprises a material which swells in the first fluid.

* * * * *